US011075459B2

(12) United States Patent
Huang et al.

(10) Patent No.: US 11,075,459 B2
(45) Date of Patent: Jul. 27, 2021

(54) MILLIMETER WAVE ANTENNA DEVICE INCLUDING PARASITIC ELEMENTS CAPABLE OF IMPROVING ANTENNA PATTERN

(71) Applicant: MEDIATEK INC., Hsin-Chu (TW)

(72) Inventors: Shao-Yu Huang, Hsinchu (TW); Yeh-Chun Kao, Hsinchu (TW); Chung-Hsin Chiang, Hsinchu (TW); Shih-Huang Yeh, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 1 day.

(21) Appl. No.: 16/745,303

(22) Filed: Jan. 16, 2020

(65) Prior Publication Data

US 2020/0243971 A1 Jul. 30, 2020

Related U.S. Application Data

(60) Provisional application No. 62/797,441, filed on Jan. 28, 2019.

(51) Int. Cl.

| | |
|---|---|
| ***H01Q 5/385*** | (2015.01) |
| ***H01Q 9/04*** | (2006.01) |
| ***H01Q 21/06*** | (2006.01) |

(52) U.S. Cl.

CPC ..... *H01Q 5/385* (2015.01); *H01Q 9/0442* (2013.01); *H01Q 21/061* (2013.01)

(58) Field of Classification Search

CPC ..... H01Q 9/0442; H01Q 9/00; H01Q 5/385; H01Q 22/061; H01Q 21/061; H01Q 21/29

See application file for complete search history.

(56) References Cited

U.S. PATENT DOCUMENTS

| | | | | |
|---|---|---|---|---|
| 5,455,594 | A * | 10/1995 | Biasing | H01Q 1/364 343/700 MS |
| 7,864,117 | B2 | 1/2011 | Aurinsalo | |
| 8,604,982 | B2 * | 12/2013 | Achour | H01Q 1/38 343/700 MS |
| 9,806,422 | B2 * | 10/2017 | Garcia | G06K 19/07749 |
| 9,853,361 | B2 * | 12/2017 | Chen | H01P 7/082 |
| 2003/0193446 | A1 | 10/2003 | Chen | |

(Continued)

FOREIGN PATENT DOCUMENTS

| | | |
|---|---|---|
| CN | 201838722 U | 5/2011 |
| CN | 104269649 A | 1/2015 |
| CN | 105140652 A | 12/2015 |

OTHER PUBLICATIONS

Qing-Xin Chu et al., "High-Gain Printed Log-Periodic Dipole Array Antenna With Parasitic Cell for 5G Communication", pp. 6338-6344, IEEE Transactions on Antennas and Propagation, vol. 65, No. 12, Dec. 2017, IEEE, USA, Dec. 2017.

(Continued)

*Primary Examiner* — Lam T Mai
(74) *Attorney, Agent, or Firm* — Winston Hsu

(57) ABSTRACT

A millimeter wave antenna device includes an antenna array, a first parasitic element and a second parasitic element. The antenna array includes m×n antennas and is disposed in an antenna area. The first parasitic element is disposed beside a first side of the antenna area. The second parasitic element is disposed beside a second side of the antenna area. None of the first parasitic element and the second parasitic element overlaps with the antenna area.

20 Claims, 9 Drawing Sheets

(56) References Cited

U.S. PATENT DOCUMENTS

| | | | | |
|---|---|---|---|---|
| 2005/0017902 | A1* | 1/2005 | Oyama | H01Q 23/00 343/700 MS |
| 2012/0242547 | A1* | 9/2012 | Fujii | H01Q 9/0414 343/700 MS |
| 2013/0321214 | A1* | 12/2013 | Zhou | H01Q 9/0428 343/700 MS |
| 2014/0361946 | A1* | 12/2014 | Ganchrow | H01Q 19/30 343/795 |
| 2015/0009070 | A1 | 1/2015 | Gregoire | |
| 2016/0285173 | A1* | 9/2016 | Svendsen | H01Q 5/328 |
| 2018/0034134 | A1* | 2/2018 | Dalmia | H01Q 19/30 |
| 2018/0048064 | A1 | 2/2018 | Boutayeb | |
| 2019/0020114 | A1* | 1/2019 | Paulotto | H01Q 9/0442 |
| 2019/0027838 | A1* | 1/2019 | Paulotto | H01Q 21/28 |
| 2021/0075088 | A1* | 3/2021 | Edwards | H01Q 5/392 |

OTHER PUBLICATIONS

Muzammil Jusoh et al., "Reconfigurable Four-Parasitic-Elements Patch Antenna for High-Gain Beam Switching Application", IEEE Antennas and Wireless Propagation Letters, vol. 13, 2014, IEEE, pp. 79-82, 2014.

* cited by examiner

MILLIMETER WAVE ANTENNA DEVICE INCLUDING PARASITIC ELEMENTS CAPABLE OF IMPROVING ANTENNA PATTERN

CROSS REFERENCE TO RELATED APPLICATIONS

This application claims priority to provisional Patent Application No. 62/797,441, filed Jan. 28, 2019, and incorporated herein by reference in its entirety.

BACKGROUND

With the advancement of wireless communications technology, the efficiency of antennas is becoming more and more important. For example, in order to achieve 5G communications, an antenna must support high-frequency signals, and the antenna is expected to support radio communications in all directions. When evaluating the effectiveness of an antenna, an antenna pattern measured using the antenna can be observed.

In order to improve the communication effect, an antenna array instead of a single antenna can be used. An antenna array can be a set of connected antennas which work together as one antenna to transmit or receive radio signals.

An antenna array has been proven to be a useful antenna device; however, in the field, an improved solution is still in need to further improve communication effects.

SUMMARY

An embodiment provides a millimeter wave antenna device. The millimeter wave antenna device includes an antenna array comprising m×n antennas and disposed in an antenna area; a first parasitic element disposed beside a first side of the antenna area; a second parasitic element disposed beside a second side of the antenna area; a first tunable component configured to adjust an impedance corresponding to the first parasitic element and comprising a first terminal coupled to the first parasitic element and a second terminal; a second tunable component configured to adjust an impedance corresponding to the second parasitic element and comprising a first terminal coupled to the second parasitic element and a second terminal; and a transceiver coupled to the antenna array, the second terminal of the first tunable component and the second terminal of the second tunable component, and configured to process signals transceived by the antenna array and control the first tunable component and the second tunable component. None of the first parasitic element and the second parasitic element overlaps with the antenna area, m and n are positive integers, and m+n>2.

Another embodiment provides a millimeter wave antenna including a first antenna array comprising m×n first antennas and disposed in a first antenna area; a first parasitic element disposed beside a first side of the first antenna area; a second parasitic element disposed beside a second side of the first antenna area; a second antenna array comprising p×q second antennas and disposed in a second antenna area; a third parasitic element disposed beside a first side of the second antenna area; and a fourth parasitic element disposed beside a second side of the second antenna area. None of the first parasitic element and the second parasitic element overlaps with the first antenna area, none of the third parasitic element and the fourth parasitic element overlaps with the second antenna area, each of the first antennas is insulated from each of the second antennas, m, n, p and q are positive integers, m+n>2, and p+q>2.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
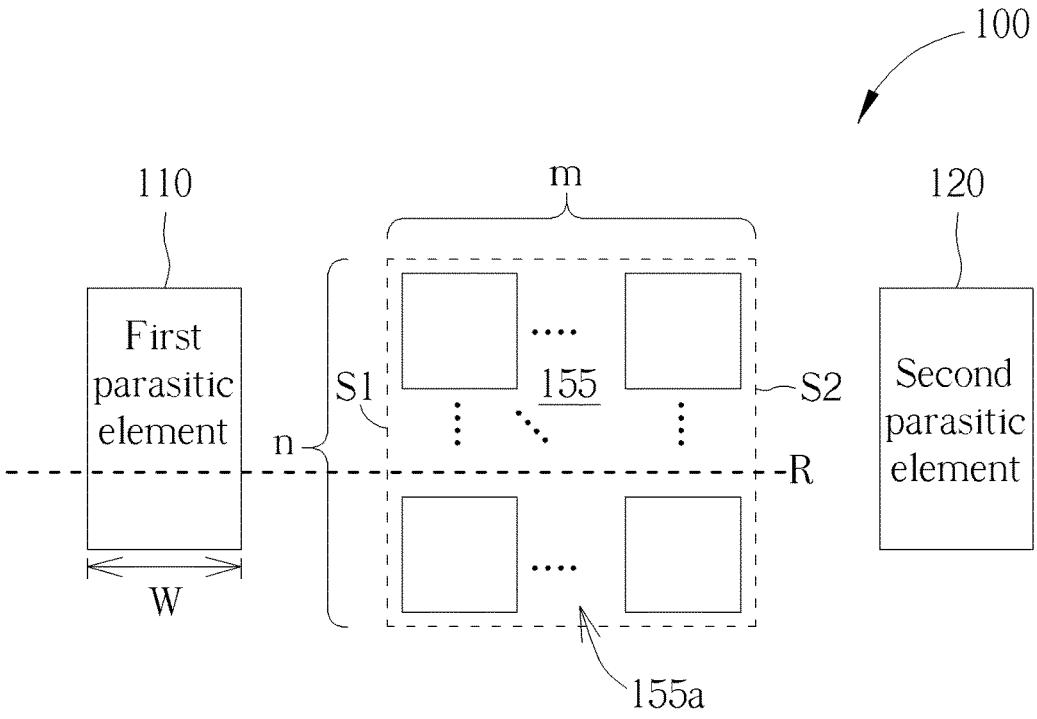
FIG. 1 illustrates a millimeter wave antenna device according to an embodiment.

FIG. 1 illustrates a millimeter wave (mmWave) antenna device 100 according to an embodiment. FIG. 1 may be a top view. The antenna device 100 may include an antenna array 155, a first parasitic element 110 and a second parasitic element 120. The antenna array 155 may include m×n antennas and disposed in an antenna area 155*a*. The first parasitic element 110 may be disposed beside a first side S1 of the antenna area 155*a*. The second parasitic element 120 may be disposed beside a second side S2 of the antenna area 155*a*. None of the first parasitic element 110 and the second parasitic element 120 overlaps with the antenna area 155*a*. m and n are positive integers, and m+n>2.

As shown in FIG. 1, according to an embodiment, the first side S1 may be opposite to the second side S2. According to another embodiment, the first side S1 may be perpendicular to the second side S2.

According to an embodiment, each of the m×n antennas in the antenna array 155 may be a patch antenna, a slot antenna, a loop antenna or a planar inverted-F antenna (PIFA).

As shown in FIG. 1, each of the first parasitic element 110 and the second parasitic element 120 may have a width W. The width W may be larger than one fourth (i.e. ¼) of a wavelength λ of a signal transceived by the antenna array 155. In other words, W>λ/4. The width W may be obtained by measuring a parasitic element along a reference line perpendicular to a corresponding side of the antenna area 155*a*. For example, as shown in FIG. 1, the width W of the first parasitic element 110 may be obtained by measuring the first parasitic element 110 along a reference line R perpendicular to the first side S2 of the antenna area 155*a*. According to an embodiment, the width W may be half of the wavelength λ to improve the transceiving effect. In other words, W=λ/2.

Figure 2:
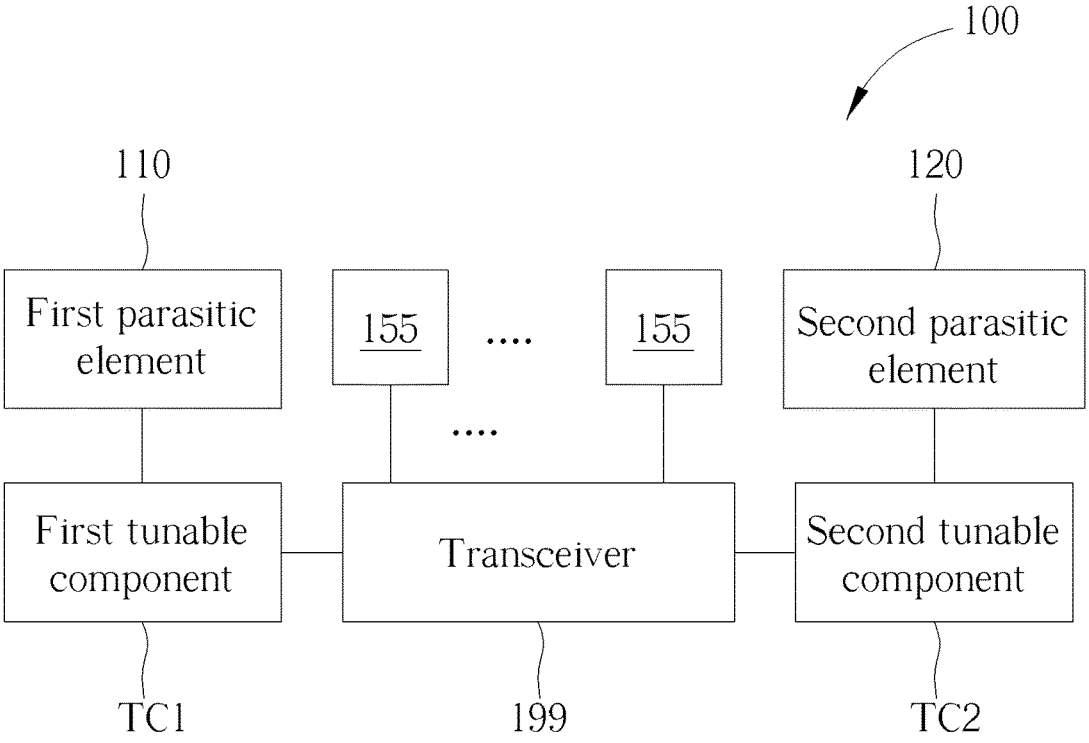
FIG. 2 illustrates a block diagram of the millimeter wave antenna device of FIG. 1.

FIG. 2 illustrates a block diagram of the millimeter wave antenna device 100 of FIG. 1. As shown in FIG. 2, the antenna device 100 may further include a first tunable component TC1, a second tunable component TC2 and a transceiver 199. FIG. 2 may show a sectional view of the antenna device 100.

The first tunable component TC1 may be used to adjust an impedance corresponding to the first parasitic element 110. The first tunable component TC1 may include a first terminal coupled to the first parasitic element 110 and a second terminal.

The second tunable component TC2 may be used to adjust an impedance corresponding to the second parasitic element 120. The second tunable component TC2 may include a first terminal coupled to the second parasitic element 120 and a second terminal.

The transceiver 199 may be coupled to the antenna array 155, the second terminal of the first tunable component TC1 and the second terminal of the second tunable component TC2. The transceiver 199 may be used to process signals transceived by the antenna array 155 and control the first tunable component TC1 and the second tunable component TC2.

The impedance corresponding to the first parasitic element 110 may be infinite (i.e. ∞) when the first tunable component TC1 is operated in an open state, and zero when the first tunable component TC1 is operated in a short state.

The impedance corresponding to the second parasitic element 120 may be infinite when the second tunable component TC2 is operated in an open state, and zero when the second tunable component TC2 is operated in a short state.

In FIG. 2, the first tunable component TC1, the second tunable component TC2 and the transceiver 199 are shown separately to be introduced; however, according to an embodiment, the first tunable component TC1, the second tunable component TC2 and the transceiver 199 may be integrated in an integrated circuit (IC).

FIG. 3 to FIG. 11 may illustrate millimeter wave antenna devices designed based on the millimeter wave antenna device 100 of FIG. 1 according to different embodiments.

Figure 3:
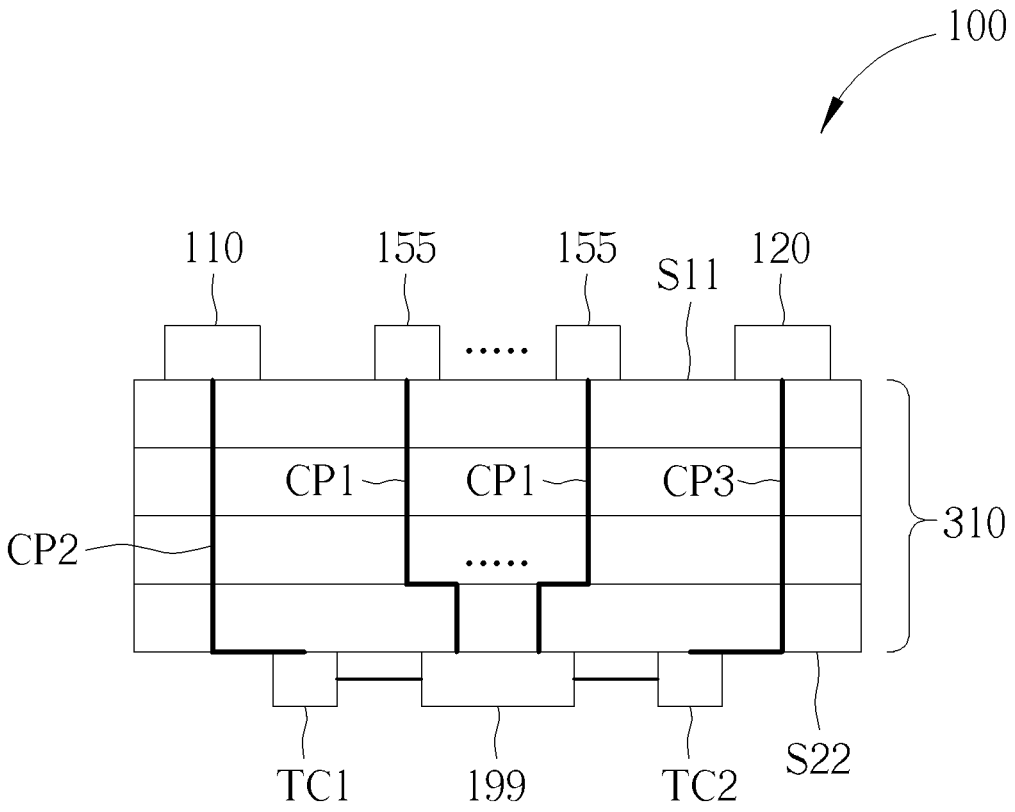
FIG. 3 to FIG. 11 illustrate millimeter wave antenna devices designed based on the millimeter wave antenna device of FIG. 1 according to different embodiments.

FIG. 3 is a sectional view of the antenna device 100 of FIG. 2 according to an embodiment. As shown in FIG. 3, the antenna device 100 may further include a circuit carrier 310. The circuit carrier 310 may be used to provide conductive paths, and the conductive paths may be programmable. For example, the circuit carrier 310 may be (but not limited to) a printed circuit board (PCB), a printed wire board (PWB) or a semiconductor packaging structure with programmable conductive paths.

As shown in FIG. 3, the circuit carrier 310 may be used to provide m×n first conductive paths CP1 coupled between the transceiver 199 and the antenna array 155, a second conductive path CP2 coupled between the first tunable component TC1 and the first parasitic element 110, and a third conductive path CP3 coupled between the second tunable component TC2 and the second parasitic element 120.

As shown in FIG. 3, the antenna array 155, the first parasitic element 110 and the second parasitic element 120 may be disposed on a first side S11 of the circuit carrier 310. The first tunable component TC1, the second tunable component TC2 and the transceiver 199 may be disposed on a second side S22 of the circuit carrier 310.

Figure 4:
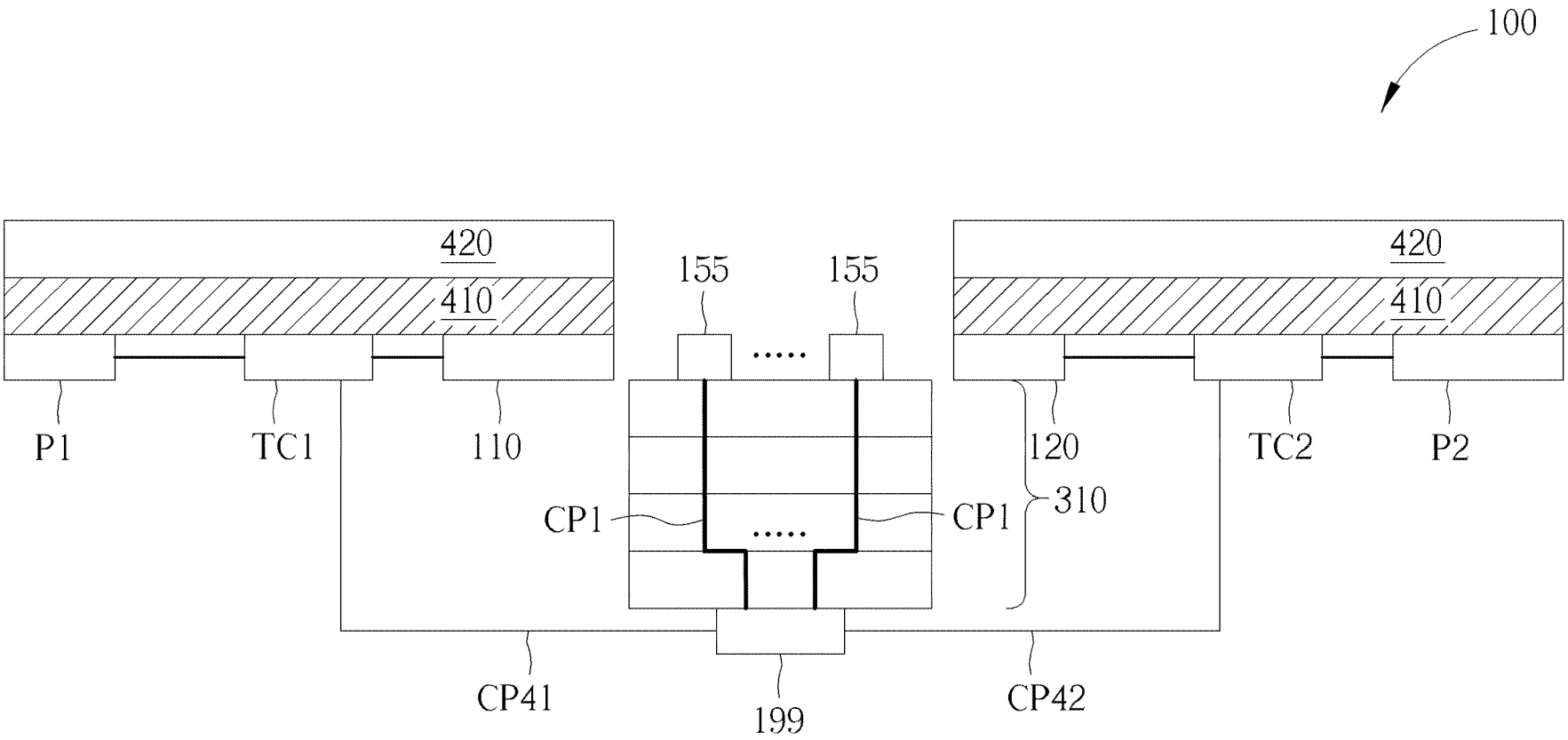

FIG. 4 is a sectional view of the millimeter wave antenna device 100 of FIG. 2 according to another embodiment. As shown in FIG. 4, the antenna device 100 may further include a substrate 410 and a cover 420. The first parasitic element 110, the second parasitic element 120, the first tunable component TC1 and the second tunable component TC2 may be disposed on a first side of the substrate 410. The cover 420 may be disposed on a second side of the substrate 410. For example, the cover 420 may be a back cover of a mobile phone. As shown in FIG. 4, the antenna device 100 may further include power units P1 and P2 disposed on the substrate 410 and coupled to the tunable components TC1 and TC2 to supply power to the tunable components TC1 and TC2. The power may be, for example, sent to the power units P1 and P2 from an external source such as a battery. According to an embodiment, the tunable components TC1 and TC2 may be controlled by the transceiver 199 or another device such as a specific circuit or controller to adjust related impedances.

By means of the structure of FIG. 4, the antenna array 155, the circuit carrier 310 and the transceiver 199 may be integrated as a first module to be applied or sold. The parasitic elements 110 and 120, the substrate 410 may be used as a second module. The cover 420 may be regarded as a third module. The foresaid first module to the third module may be assembled. Hence, the flexibility of design is improved.

Figure 5:
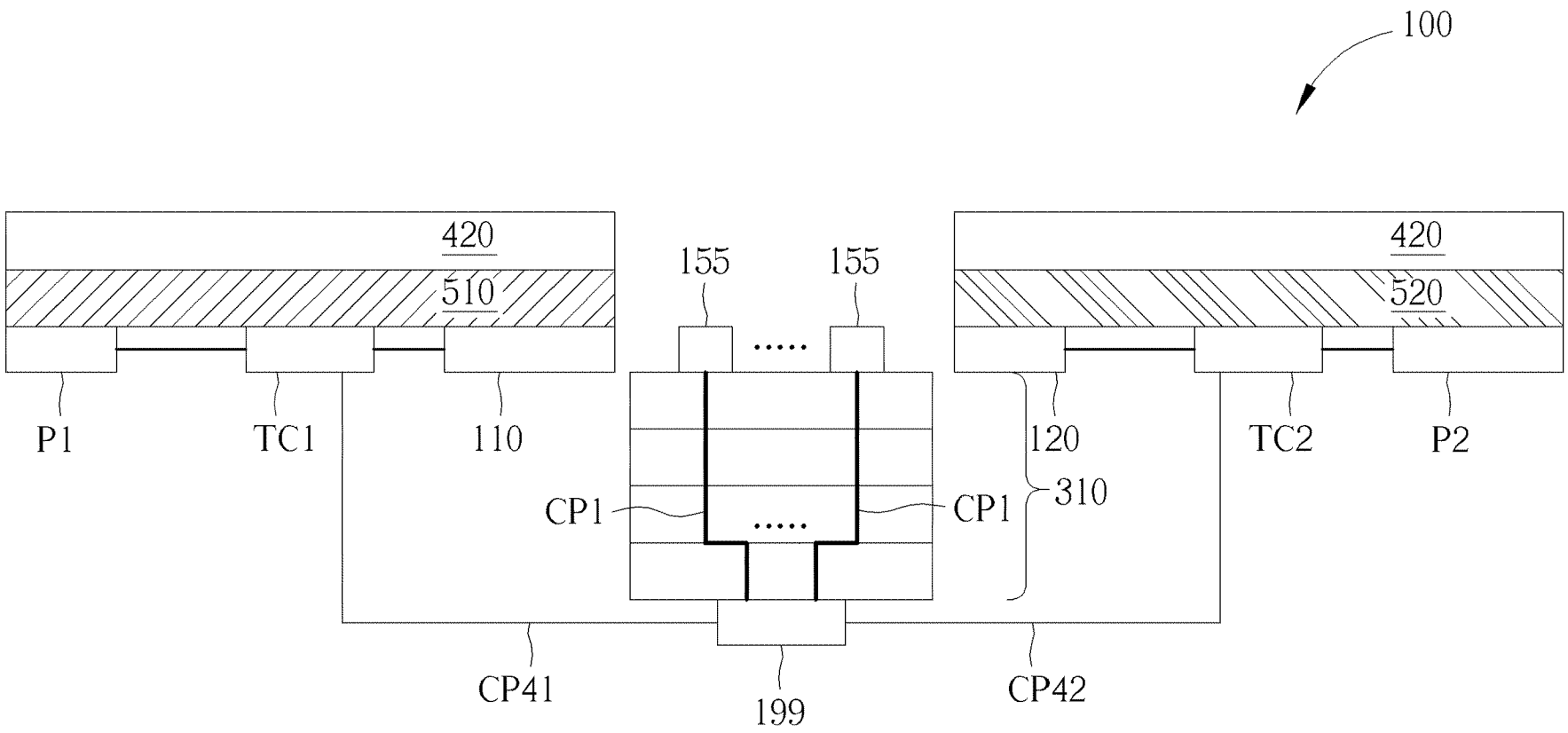

FIG. 5 is a sectional view of the millimeter wave antenna device 100 of FIG. 2 according to another embodiment. The antenna device 100 of FIG. 5 may be similar to the antenna device 100 of FIG. 4. However, the antenna device 100 of FIG. 5 may include two separate substrates 510 and 520. The first parasitic element 110 and the first tunable component TC1 may be disposed on a first side of the first substrate 510. The second parasitic element 120 and the second tunable component TC2 may be disposed on a first side of the second substrate 520. The cover 420 (e.g., a back cover of a mobile phone) may be disposed on a second side of the first substrate 510 and a second side of the second substrate 520. In FIG. 5, by using the two separate substrates 510 and 520, the flexibility of design is further improved.

As shown in FIG. 4 and FIG. 5, the antenna device 100 may include conductive paths CP41 and CP42. The conductive path CP41 may be coupled to the transceiver 199 and the first tunable component TC1. The conductive path CP42 may be coupled to the transceiver 199 and the second tunable component TC2. In FIG. 4 and FIG. 5, the transceiver 199 may control the first tunable component TC1 through the conductive path CP41, and control the second tunable component TC1 through the conductive path CP42.

According to an embodiment, for example, each of the conductive paths CP41 and CP42 may be formed using a path of a circuit carrier such as (but not limited to) a flexible printed circuit (FPC) board. For example, each of the conductive paths CP41 and CP42 may pass through a solder ball or a suitable conductive pad.

Figure 6:
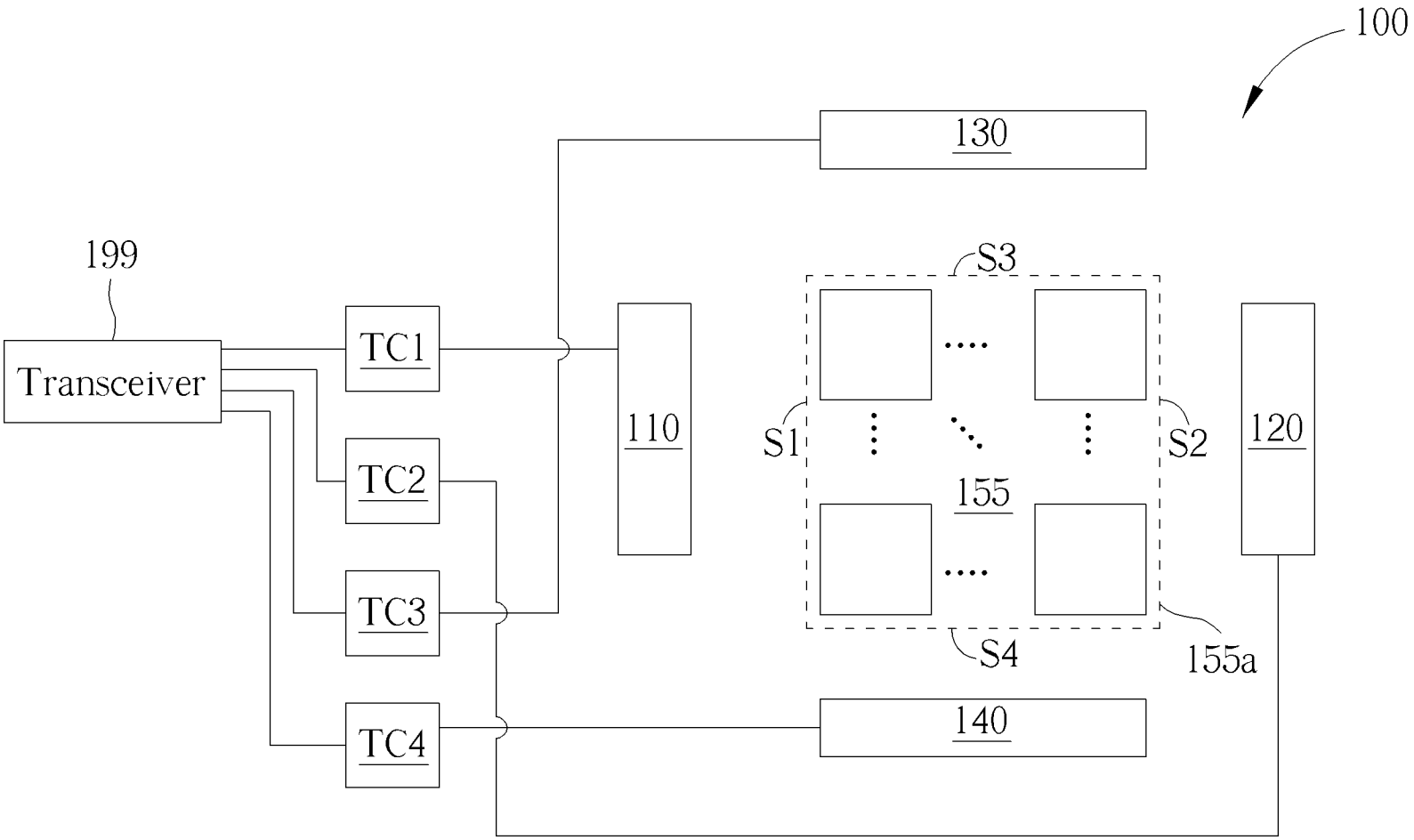

FIG. 6 illustrates the millimeter wave antenna device 100 according to another embodiment. In addition to the parasitic elements 110 and 120 shown in FIG. 1, the antenna device 100 of FIG. 6 may further include a third parasitic element 130 and a fourth parasitic element 140. The third parasitic element 130 may be disposed beside a third side S3 of the antenna area 155*a*. The fourth parasitic element 140 may be disposed beside a fourth side S4 of the antenna area 155*a*. The third parasitic element 130 may not overlap with the antenna area 155*a*, and the fourth parasitic element 140 may not overlap with the antenna area 155*a*.

As shown in FIG. 6, the first side S1 may be opposite to the second side S2. The third side S3 may be perpendicular to the first side S1 and the second side S2, the fourth side is perpendicular to the first side S1 and the second side S2. The third side S3 may be opposite to the fourth side S4.

As shown in FIG. 6, the antenna device 100 may further include a first tunable component TC1, a second tunable component TC2, a third tunable component TC3 and a fourth tunable component TC4 used to respectively adjust impedances corresponding to the parasitic elements 110 to 140. The tunable components TC1 and TC2 may be like that of FIG. 2, so it is not repeatedly described. The third tunable component TC3 may include a first terminal coupled to the third parasitic element 130, and a second terminal. The fourth tunable component TC4 may and include a first terminal coupled to the fourth parasitic element, and a second terminal. Like FIG. 2, the antenna device 100 may further include a transceiver 199. The transceiver 199 may be coupled to the antenna array 155 and the second terminals of the tunable components TC1 to TC4. The transceiver 199 may be used to process signals transceived by the antenna array 155 and control the tunable components TC1 to TC4.

In FIG. 6, the positions of the transceiver 199 and the tunable components TC1 to TC4 are merely as an example to describe the relationships among the elements instead of limiting the scope of embodiments. For example, the transceiver 199 and the tunable components TC1 to TC4 mentioned in FIG. 6 may be disposed on a circuit carrier and/or on one or more substrate(s) to support various types of applications as shown in FIG. 3 and FIG. 5 based on different embodiments.

Figure 7:
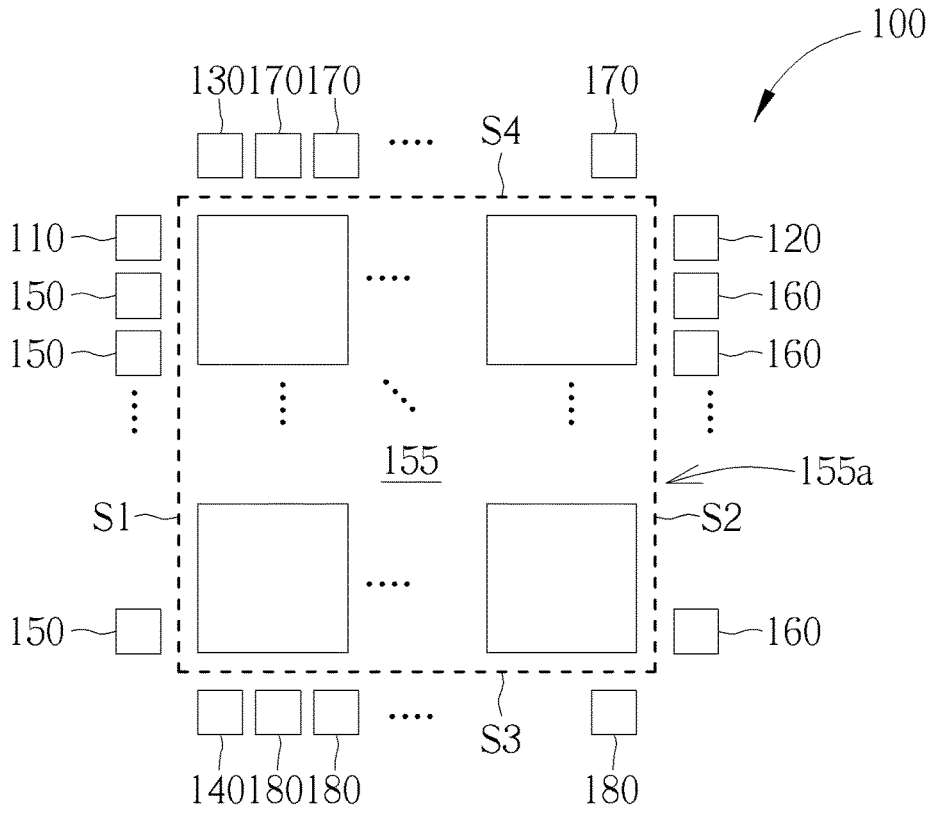

FIG. 7 illustrates the millimeter wave antenna device 100 according to another embodiment. The antenna device 100 of FIG. 7 may be similar to the antenna device 100 of FIG. 6; however, the antenna device 700 may further include α fifth parasitic elements 150, β sixth parasitic elements 160, γ seventh parasitic elements 170 and δ eighth parasitic elements 180. As shown in FIG. 7, the α fifth parasitic elements 150 may be disposed beside the first side of the antenna area 155*a*. The β sixth parasitic elements 160 may be disposed beside the second side S2 of the antenna area 155*a*. The γ seventh parasitic elements 170 may be disposed beside the third side S3 of the antenna area 155*a*. The δ eighth parasitic elements 180 may be disposed beside the fourth side S4 of the antenna area 155*a*. None of the parasitic elements 150, 160, 170 and 180 overlaps with the antenna area 155*a*. α, β, γ and δ are positive integers, $\alpha>0$, $\beta>0$, $\gamma>0$ and $\delta>0$.

Figure 8:
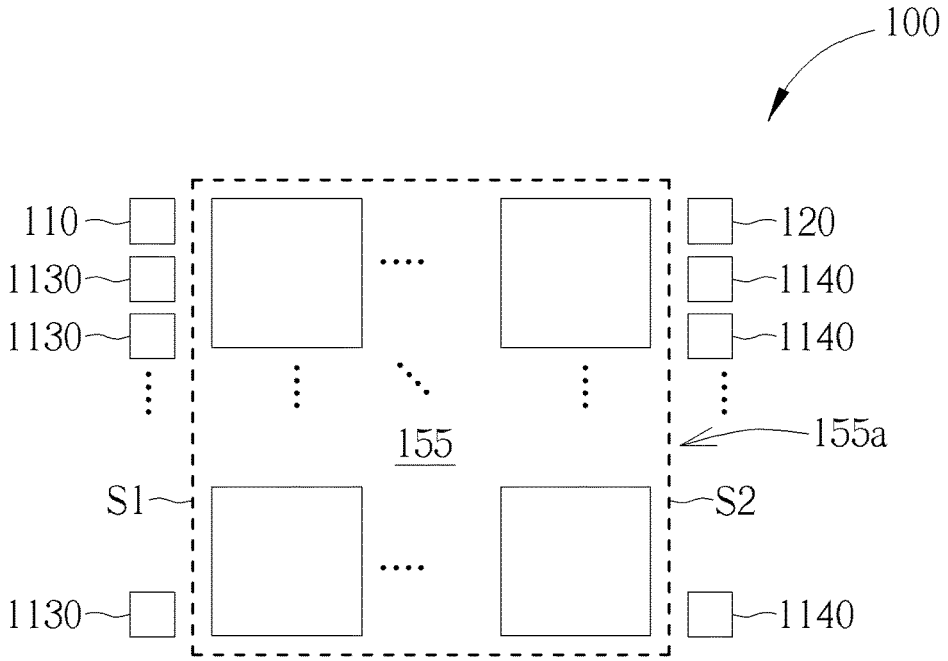

As shown in FIG. 7, a plurality of parasitic elements may be disposed beside a side of the antenna area to improve the antenna pattern. FIG. 8 may provide another example as follows.

FIG. 8 illustrates the millimeter wave antenna device 100 according to another embodiment. FIG. 8 may be like FIG. 1; however, the antenna device 100 may further include x third parasitic elements 1130 and y fourth parasitic elements 1140. The x third parasitic elements 1130 disposed beside the first side S1 of the antenna area 155*a*. They fourth parasitic elements 1140 disposed beside the second side S2 of the antenna area 155*a*. x and y are positive integers, $x>0$ and $y>0$.

Regarding FIG. 7 and FIG. 8, the parasitic elements disposed beside a same side of the antenna area 155*a* may be coupled to a same tunable component to be controlled as a group. According to another embodiment, more tunable components may be used, and the parasitic elements disposed beside a same side of the antenna area 155*a* may be controlled by two or more tunable components to control the impedances more finely.

Regarding FIG. 7 and FIG. 8, the parasitic elements may be disposed on a circuit carrier as shown in FIG. 3, or disposed on a substrate as shown in FIG. 4. The parasitic elements may be grouped and disposed on different substrates as shown in FIG. 5 where a set of parasitic elements in a same group may be disposed on a same substrate. In other words, the structures described in FIG. 3 to FIG. 5 may be feasible for the cases of FIG. 7 and FIG. 8.

Figure 9:
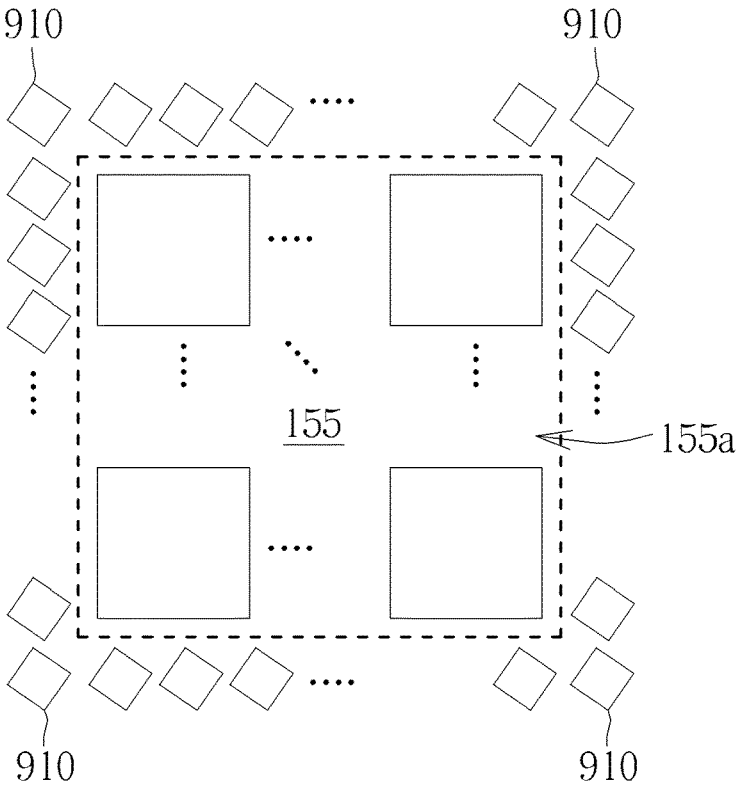
Figure 10:
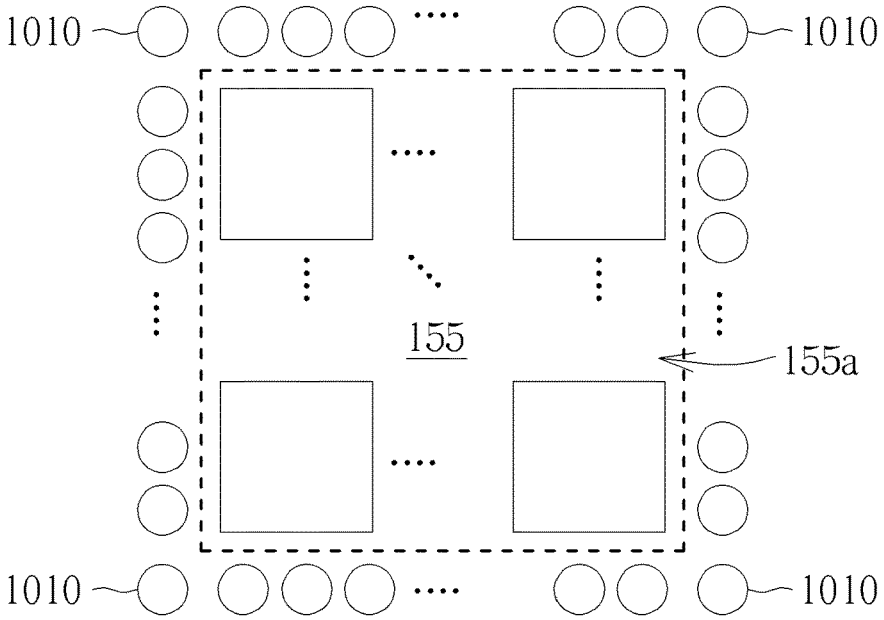

In the antenna device 100 mentioned above, according to embodiments, each parasitic element may have a rectangular shape, a circular shape, a rhombus shape or a parallelogram shape. FIG. 9 and FIG. 10 illustrate the millimeter wave antenna devices 100 according to two embodiments. As shown in FIG. 9, each of the parasitic elements disposed beside the antenna area 155*a* may have a parallelogram shape which may be a rectangular shape being rotated by an angle. As shown in FIG. 10, each of the parasitic elements disposed beside the antenna area 155*a* may have a circular shape. In addition, as the parasitic elements 910 and 1010 in FIG. 9 and FIG. 10, parasitic elements may be disposed beside corners of the antenna area 155*a*.

According to an embodiment, each of the abovementioned antenna arrays (e.g., 155, 1155 and 1955) may be operated at a frequency higher than seven gigahertz (GHz). In other words, signals transmitted and/or received by the antenna array may be at a frequency higher than seven gigahertz. The millimeter wave antenna devices of FIG. 1 to FIG. 11 may support 5G communications.

Figure 11:
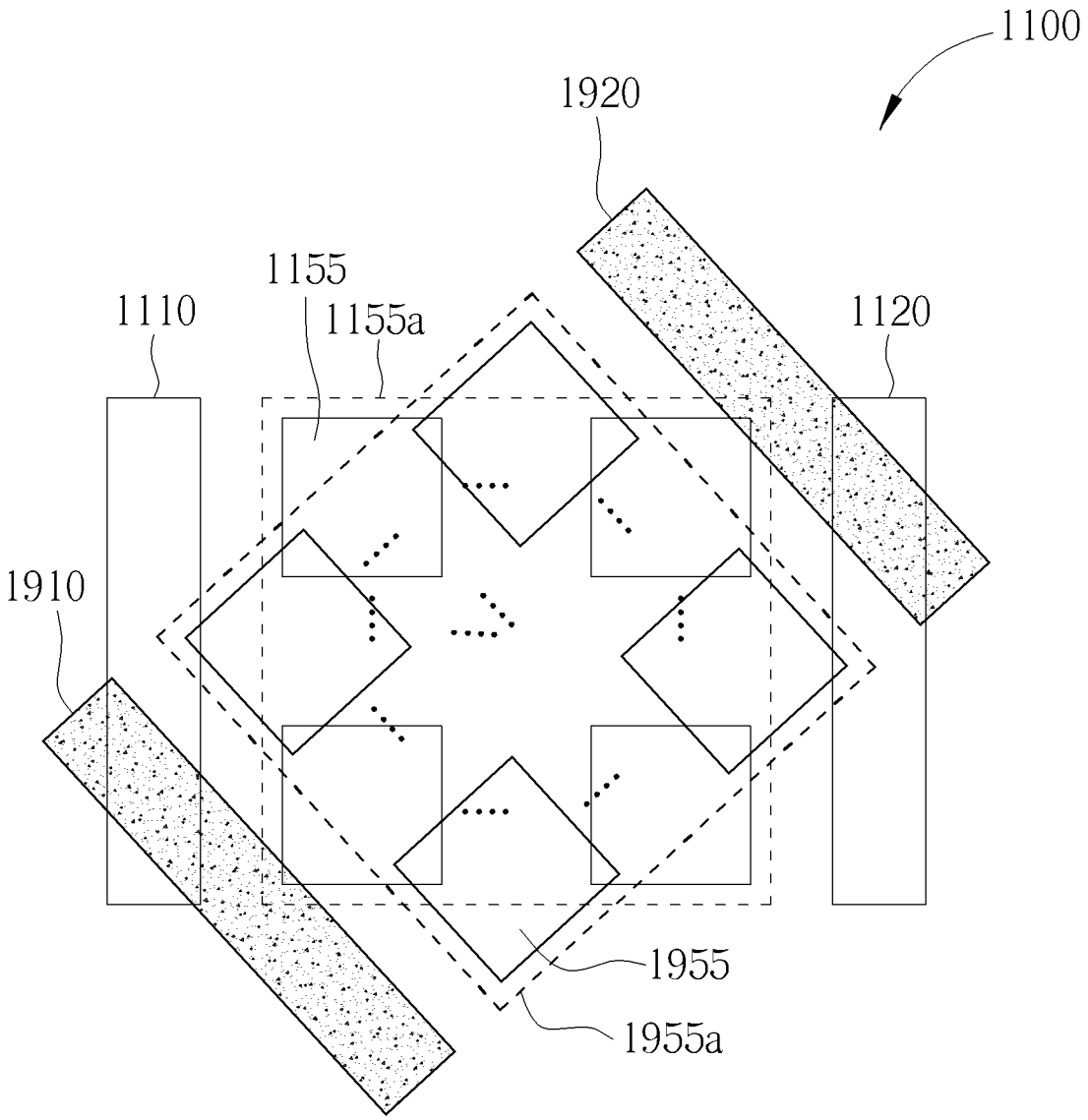

FIG. 11 illustrates a millimeter wave antenna device 1100 according to another embodiment. The antenna device 1100 include a first antenna array 1155, a first parasitic element 1110, a second parasitic element 1120, a second antenna array 1955, a third parasitic element 1910 and a fourth parasitic element 1920.

The first antenna array 1155 may include m×n first antennas and disposed in a first antenna area 1155*a*. The first parasitic element 1110 may be disposed beside a first side of the first antenna area 1155*a*. The second parasitic element 1120 may be disposed beside a second side of the first antenna area 1155*a*. The second antenna array 1955 may include p×q second antennas and disposed in a second antenna area 1955*a*. The third parasitic element 1910 may be disposed beside a first side of the second antenna area 1955*a*. The fourth parasitic element 1920 may be disposed beside a second side of the second antenna area 1955*a*.

None of the first parasitic element 1110 and the second parasitic element 1120 may overlap with the first antenna area 1155*a*. None of the third parasitic element 1910 and the fourth parasitic element 1920 may overlap with the second antenna area 1955*a*. Each of the antennas of the antenna array 1155 may be insulated from each of the antennas of the antenna array 1955. m, n, p and q are positive integers, $m+n>2$, and $p+q>2$.

As shown in FIG. 11, the first antenna area 1155*a* may partially overlap with the second antenna area 1955*a* and be unaligned with the second antenna area 1955*a*.

Figure 12:
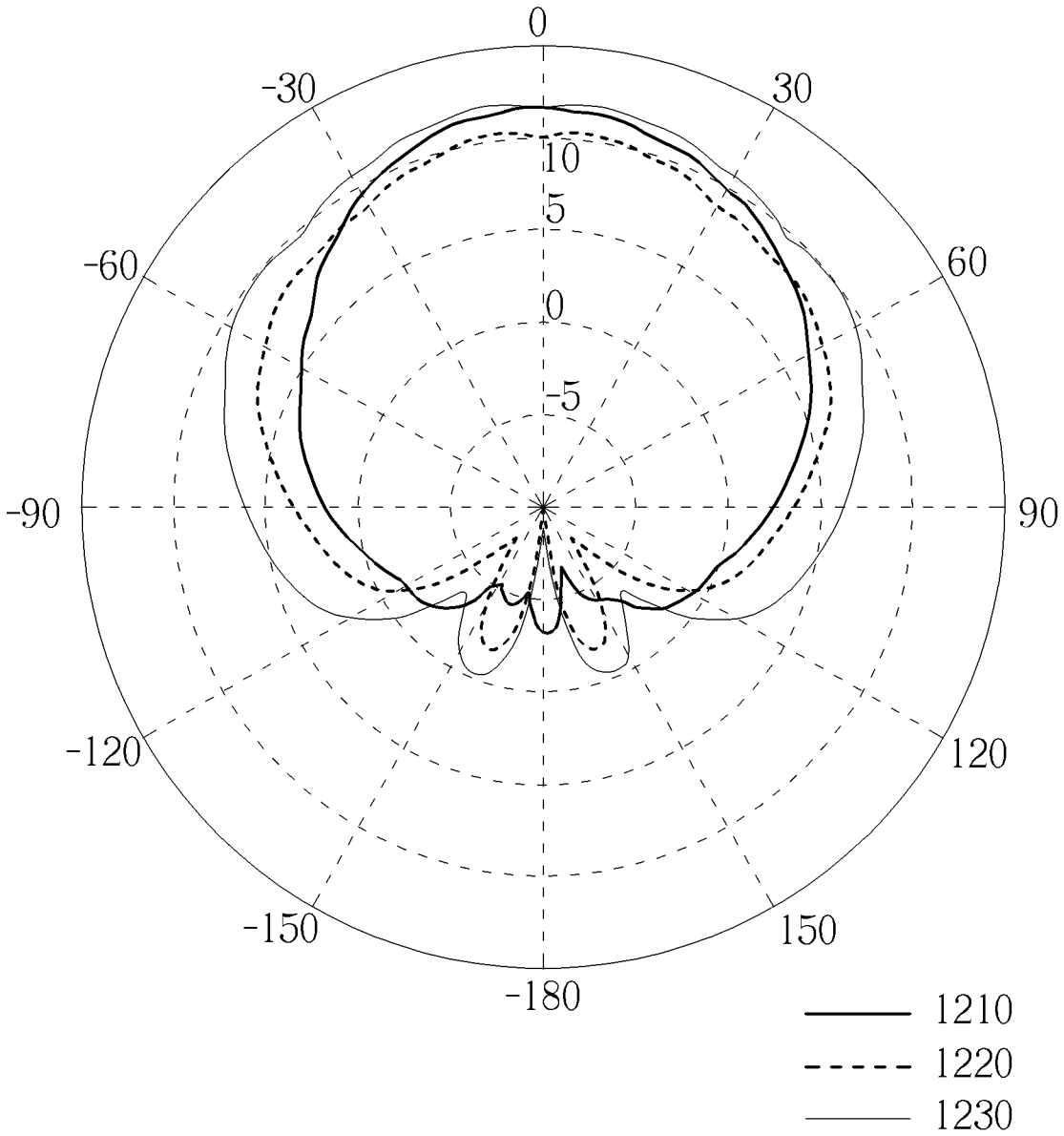
FIG. 12 illustrates antenna patterns of different cases.

FIG. 12 illustrates antenna patterns of different cases. In FIG. 12, a pattern 1210 is measured when an antenna device has no parasitic element. A pattern 1220 is measured when an antenna device has parasitic elements overlapping with an antenna area containing an antenna array. A pattern 1230 is measured for the antenna device 100 in FIG. 6.

As shown in FIG. 12, at the angle of 90 degree (denoted as +90°), the patterns 1210 to 1230 are respectively corresponding antenna gains of 2.5 dBi (decibel isotropic), 3.8 dBi and 6.2 dBi. Hence, at +90°, the antenna gain is improved by 3.7 dBi when comparing to the pattern 1210. Since the pattern 1230 is obtained for an antenna device with four parasitic elements, each parasitic element improves the antenna gain by about 0.9 dBi.

In summary, by means of antenna devices disclosed by the embodiments, the antenna gain is greatly improved, and flexibility of design and application is provided.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A millimeter wave antenna device comprising:

an antenna array comprising m×n antennas and disposed in an antenna area;

a first parasitic element disposed beside a first side of the antenna area;

a second parasitic element disposed beside a second side of the antenna area;

a first tunable component configured to adjust an impedance corresponding to the first parasitic element and comprising a first terminal coupled to the first parasitic element and a second terminal;

a second tunable component configured to adjust an impedance corresponding to the second parasitic element and comprising a first terminal coupled to the second parasitic element and a second terminal; and a transceiver coupled to the antenna array, the second terminal of the first tunable component and the second terminal of the second tunable component, and configured to process signals transceived by the antenna array and control the first tunable component and the second tunable component;

wherein none of the first parasitic element and the second parasitic element overlaps with the antenna area, m and n are positive integers, and m+n>2.

2. The millimeter wave antenna device of claim 1, wherein the first side is opposite to the second side.

3. The millimeter wave antenna device of claim 1, wherein the impedance corresponding to the first parasitic element is infinite when the first tunable component is operated in an open state, and zero when the first tunable component is operated in a short state.

4. The millimeter wave antenna device of claim 3, wherein the impedance corresponding to the second parasitic element is infinite when the second tunable component is operated in an open state, and zero when the second tunable component is operated in a short state.

5. The millimeter wave antenna device of claim 1, wherein the first tunable component, the second tunable component and the transceiver are integrated in an integrated circuit.

6. The millimeter wave antenna device of claim 1, further comprising:

a circuit carrier configured to provide m×n first conductive paths coupled between the transceiver and the antenna array, a second conductive path coupled between the first tunable component and the first parasitic element, and a third conductive path coupled between the second tunable component and the second parasitic element;

wherein the antenna array, the first parasitic element and the second parasitic element are disposed on a first side of the circuit carrier, and the first tunable component, the second tunable component and the transceiver are disposed on a second side of the circuit carrier.

7. The millimeter wave antenna device of claim 1, further comprising:

a substrate wherein the first parasitic element, the second parasitic element, the first tunable component and the second tunable component are disposed on a first side of the substrate; and a cover disposed on a second side of the substrate.

8. The millimeter wave antenna device of claim 1, further comprising:

a first substrate wherein the first parasitic element and the first tunable component are disposed on a first side of the first substrate;

a second substrate wherein the second parasitic element and the second tunable component are disposed on a first side of the second substrate; and a cover disposed on a second side of the first substrate and a second side of the second substrate.

9. The millimeter wave antenna device of claim 1, wherein a width of each of the first parasitic element and the second parasitic element is larger than one fourth of a wavelength of a signal transceived by the antenna array.

10. The millimeter wave antenna device of claim 1, wherein a width of each of the first parasitic element and the second parasitic element is half of a wavelength of a signal transceived by the antenna array.

11. The millimeter wave antenna device of claim 1, further comprising:

a third parasitic element disposed beside a third side of the antenna area; and a fourth parasitic element disposed beside a fourth side of the antenna area;

wherein the third parasitic element does not overlap with the antenna area, and the fourth parasitic element does not overlap with the antenna area.

12. The millimeter wave antenna device of claim 11, wherein the first side is opposite to the second side, the third side is perpendicular to the first side and the second side, the fourth side is perpendicular to the first side and the second side, and the third side is opposite to the fourth side.

13. The millimeter wave antenna device of claim 11, further comprising:

a third tunable component configured to adjust an impedance corresponding to the third parasitic element and comprising a first terminal coupled to the third parasitic element, and a second terminal; and a fourth tunable component configured to adjust an impedance corresponding to the fourth parasitic element and comprising a first terminal coupled to the fourth parasitic element, and a second terminal;

wherein the transceiver is further coupled to the second terminal of the third tunable component and the second terminal of the fourth tunable component, and further configured to control the third tunable component and the fourth tunable component.

14. The millimeter wave antenna device of claim 11, further comprising:

α fifth parasitic elements disposed beside the first side of the antenna area;

β sixth parasitic elements disposed beside the second side of the antenna area;

γ seventh parasitic elements disposed beside the third side of the antenna area; and δ eighth parasitic elements disposed beside the fourth side of the antenna area;

wherein none of the α fifth parasitic elements, the β sixth parasitic elements, the γ seventh parasitic elements and the δ eighth parasitic elements overlaps with the antenna area, α, β, γ and δ are positive integers, α>0, β>0, γ>0 and δ>0.

15. The millimeter wave antenna device of claim 1, further comprising:

x third parasitic elements disposed beside the first side of the antenna area; and y fourth parasitic elements disposed beside the second side of the antenna area;

wherein none of the x third parasitic elements and the y fourth parasitic elements overlaps with the antenna area, x and y are positive integers, x>0 and y>0.

16. The millimeter wave antenna device of claim 1, wherein each of the first parasitic element and the second parasitic element has a rectangular shape, a circular shape, a rhombus shape or a parallelogram shape.

17. The millimeter wave antenna device of claim 1, wherein each of the m×n antennas is a patch antenna, a slot antenna, a loop antenna or a planar inverted-F antenna.

18. The millimeter wave antenna device of claim 1, wherein the antenna array is operated at a frequency higher than seven gigahertz.

19. A millimeter wave antenna device comprising:

a first antenna array comprising m×n first antennas and disposed in a first antenna area;

a first parasitic element disposed beside a first side of the first antenna area;

a second parasitic element disposed beside a second side of the first antenna area;

a second antenna array comprising p×q second antennas and disposed in a second antenna area;

a third parasitic element disposed beside a first side of the second antenna area; and a fourth parasitic element disposed beside a second side of the second antenna area;

wherein none of the first parasitic element and the second parasitic element overlaps with the first antenna area, none of the third parasitic element and the fourth parasitic element overlaps with the second antenna area, each of the first antennas is insulated from each of the second antennas, m, n, p and q are positive integers, $m+n>2$ and $p+q>2$.

20. The millimeter wave antenna device of claim 19, wherein the first antenna area partially overlaps with the second antenna area and is unaligned with the second antenna area.

* * * * *